United States Patent [19]

Wu

[11] 4,449,636

[45] May 22, 1984

[54] NURSING BOTTLE WITH DISPOSABLE INSERT

[76] Inventor: Wen-Yu Wu, 28925 Pinecastle Dr., Rancho P.V., Calif. 90274

[21] Appl. No.: 384,667

[22] Filed: Jun. 3, 1982

[51] Int. Cl.[3] ..... A61J 9/00

[52] U.S. Cl. ..... 215/11 E

[58] Field of Search ..... 215/11 R, 11 E, 11 C

[56] References Cited

U.S. PATENT DOCUMENTS

| | | | |
|---|---|---|---|
| 686,109 | 11/1901 | Mulhens | 215/11 R |
| 1,589,138 | 6/1926 | Fisk | 215/11 E |
| 2,328,354 | 8/1943 | Montano | 215/11 E |
| 2,372,281 | 3/1945 | Jordan | 215/11 R |
| 2,574,931 | 11/1951 | Nason, Jr. | 222/105 |
| 2,803,365 | 8/1957 | Allen | 215/11 E |
| 2,881,935 | 4/1959 | Garred | 215/11 E |
| 2,939,598 | 6/1960 | Donleavy | 215/11 R |
| 3,022,915 | 2/1962 | Mullin | 215/11 R |
| 3,055,525 | 9/1962 | Coleman, Jr. | 215/11 R |
| 3,070,249 | 12/1962 | Sehrwald | 215/11 R |
| 3,263,848 | 8/1966 | Zackheim | 215/11 R |
| 3,401,813 | 9/1968 | Sherwood | 215/11 C |
| 3,507,666 | 4/1970 | Cheney et al. | 215/11 R X |
| 3,871,542 | 3/1975 | Hammer | 215/11 E |

*Primary Examiner*—William Price
*Assistant Examiner*—Sue A. Weaver

[57] ABSTRACT

A nursing bottle is formed by the combination of a rigid enclosure, a flexible, disposable insert with an integral nipple and a covering member which seals the bottle when filled. The rigid enclosure is provided with an imperforate, nipple-shaped protrusion which extends substantially vertically from its open end to act as a nipple support. The disposable insert is formed with a first nipple having a perforation and a second imperforate nipple which, when mounted together on the nipple-shaped protrusion, permit the open end of the insert to be folded against the side of the enclosure where it may be tightly secured in place by a covering member to seal the bottle.

12 Claims, 7 Drawing Figures

NURSING BOTTLE WITH DISPOSABLE INSERT

BRIEF STATEMENT OF THE INVENTION

This invention relates to a nursing bottle having a flexible disposable insert in combination with a rigid enclosure. More particularly, this invention relates to a relatively rigid enclosure with a nipple-shaped protrusion, and a flexible disposable insert with a nipple, which is positioned within the enclosure by the protrusion. The insert is sealed after being filled, by folding the open end of the insert over the enclosure and tightly securing the folded end to the enclosure wall with a covering member.

OBJECTS OF THE INVENTION

An example of the many objects of this invention is to provide a disposable nursing bottle that includes an insert with an integral nipple, which insert is discarded after using so that sterilization of the nursing bottle and nipple is not required. Another object of this invention is to provide an integral, flexible nipple on an insert which is supported by a relatively rigid nipple-shaped protrusion so that the nipple is stiff enough for an infant to nurse.

DESCRIPTION OF THE PREFERRED EMBODIMENT

Figure 1:
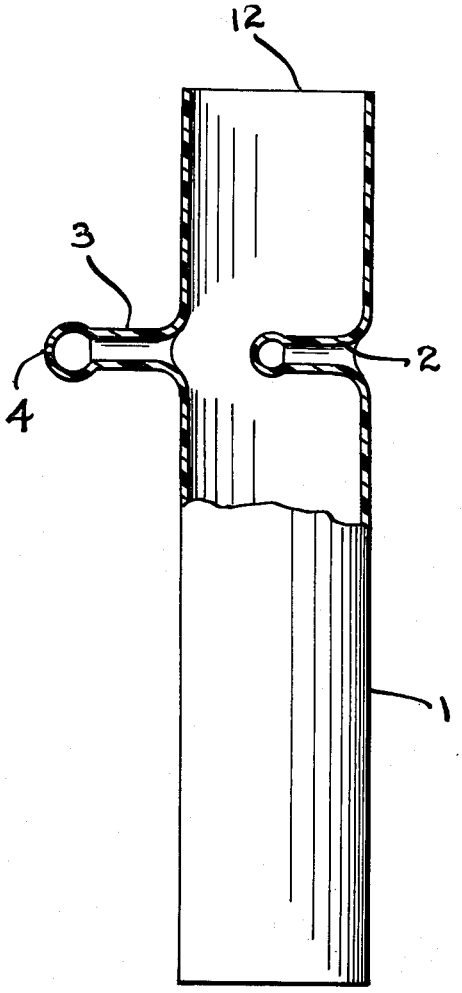
FIG. 1 is an elevational view, partly shown in section, of the disposable insert.

The nursing bottle of the invention comprises three separate components; an enclosure, an insert and a covering member. As shown in FIG. 1, the disposable insert 1 is formed as a flexible container having an opening at one end 12; a first nipple 3, which is perforated at 4, and which is integral with and projects outwardly from the wall of the container; a second smaller, imperforate nipple 2, which is located diametrically opposite of the first nipple and projects inwardly from the container wall.

Figure 2:
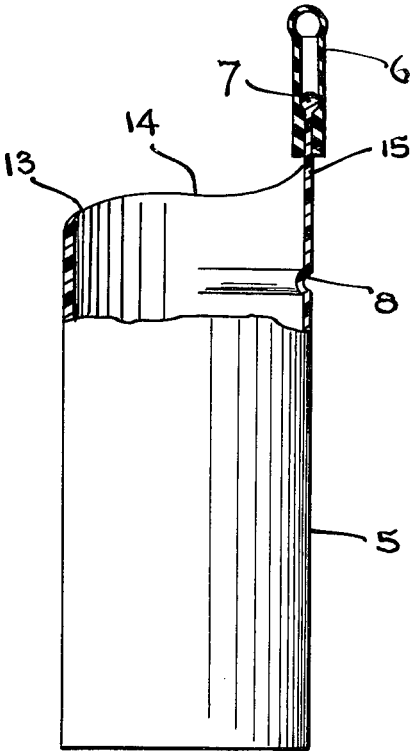
FIG. 2 is an elevational view, partly shown in section, of the rigid enclosure.

FIG. 2 shows the rigid enclosure 5 which is formed as a hollow cylinder having a rim 13 at one end to define an opening 14 and a protrusion, located on one side of and extending substantially vertically from an upper edge of the rim, which consists of a stem 15 with a round ball 7 on the end supporting an imperforate, nipple-shaped protrusion 6 made of rubber. The rigid enclosure is also formed with an indentation 8 which is located on a sidewall, below the protrusion 6.

Figure 4:
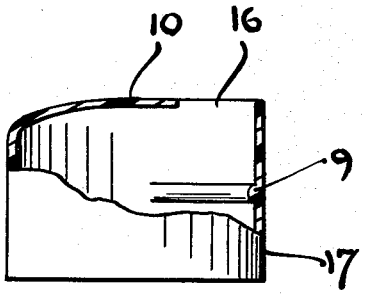
FIG. 4 is an elevational view, partly shown in section, of the covering member.
Figure 3:
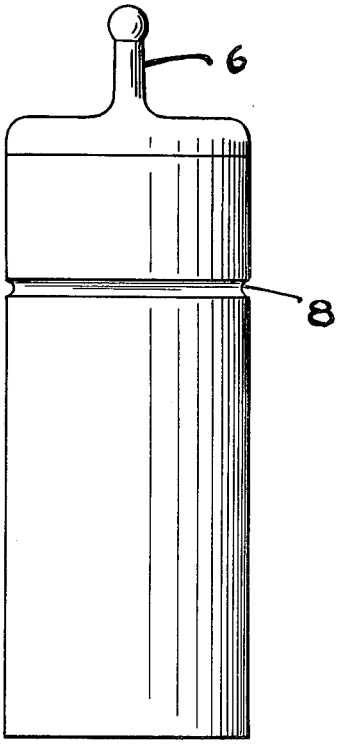
FIG. 3 is a right side view of FIG. 2.

The covering member 10, shown in FIG. 4, is formed with an opening 16 so as to permit the protrusion 8, the first nipple 3 and the second nipple 2 to extend out of the covering member when it is applied to the opening 14 of the enclosure to seal the insert 1. The covering member 10 is also formed with a depending skirt 17 which has a projection 9 located on its inner surface. The projection 9 is sized so as to cooperate with the enclosure indentation 8 to tightly secure the open end 12 of the insert, in sealing relationship.

Figure 5:
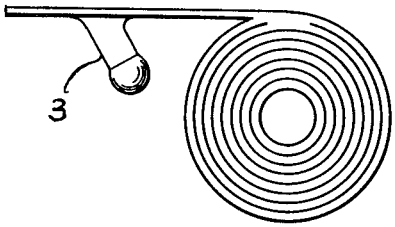
FIG. 5 is a perspective view showing a roll of the disposable inserts with the nipple protected from contamination.
Figure 6:
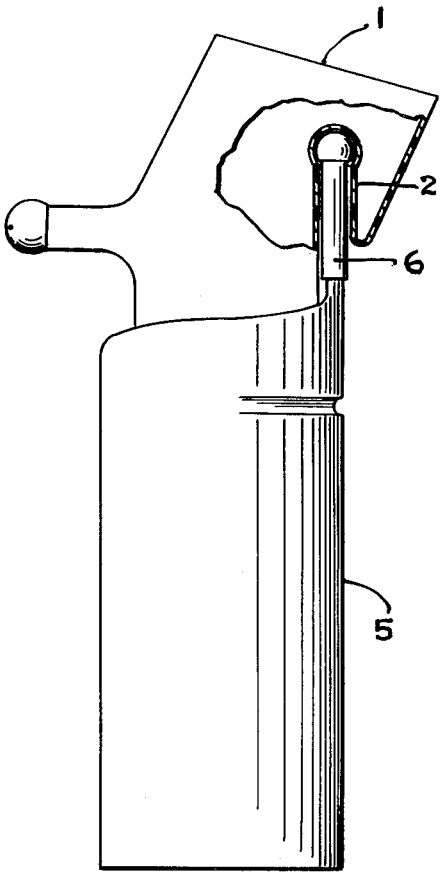
FIG. 6 is an elevational view of the insert supported on the nipple-shaped protrusion and open for filling.
Figure 7:
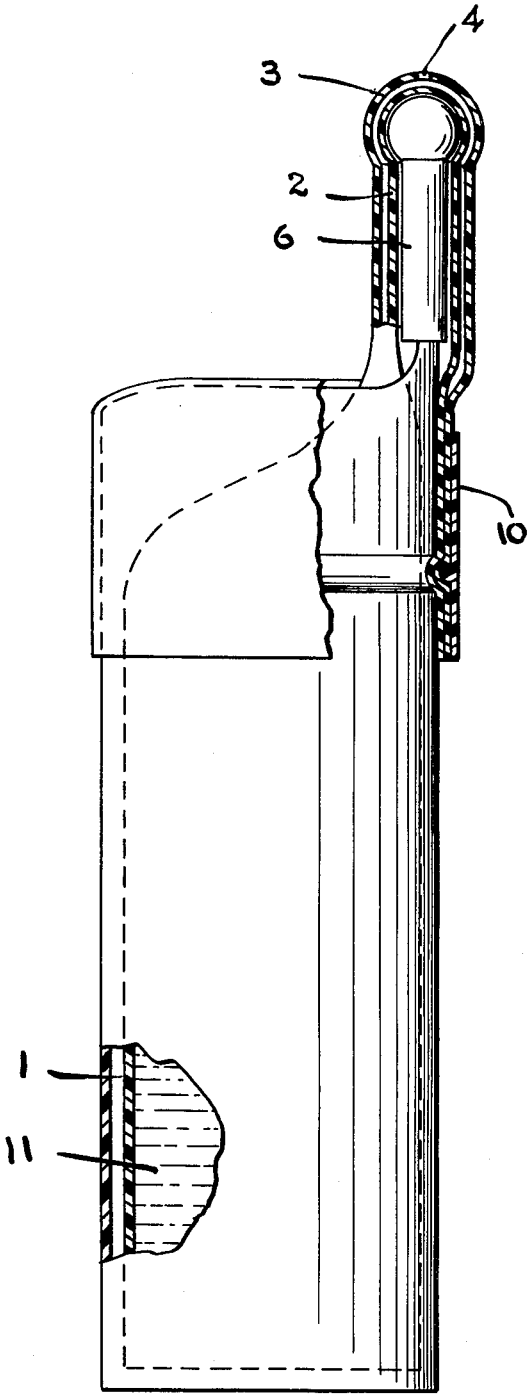
FIG. 7 is an elevational view, partly shown in section, showing the nursing bottle assembled with the disposable insert filled and sealed.

FIGS. 5–7 show a step by step assembly of the preferred embodiment of the invention. As shown in FIG. 5, the disposable insert is connected to a series of identical inserts which are rolled up with the first nipple 3 within the roll to protect it from contamination. A line of perforations may be provided at the end of each insert so that the insert can be easily separated for use. The insert 1 is then placed in the rigid enclosure 5, with the second imperforate nipple 2 mounted on the nipple-shaped protrusion 6 (note FIG. 6). With the insert 1 supported in this manner, the bottle may be filled with liquid 11. After filling, the first perforated nipple 3 is placed over the top of the second imperforate nipple 2 which is supported by the nipple-shaped protrusion 6. With the first and second nipples supported in this manner, the open end 12 of the insert 1 is folded along the sidewall of the enclosure. The filled bottle may then be sealed by placing the covering member 10 over the opening 14 of the enclosure with the supported nipples 2 and 3 extending through the opening 16 in the covering member 10. When the projection 9 on the skirt 17 of the covering member 10 engages with the indentation 8 on the wall of the enclosure, the folded open end 12 of the insert 1 becomes tightly secured between the enclosure wall and the skirt 17 of the covering member to complete the sealing operation.

As shown in FIG. 7, when the bottle is assembled and filled, the liquid 11 in the insert 1 can flow between the first perforated nipple 3 and the second imperforate nipple 2 and can be withdrawn through the perforation 4 by an infant.

The present invention is not intended to be limited to the specific details disclosed except insofar as such limitations are included in the claims.

I claim:

1. A disposable insert for a nursing bottle comprising: a flexible container having an opening at one end; a first perforated nipple integral with the wall of the container and projecting outwardly therefrom; a second smaller, imperforate nipple located diametrically opposite of said first nipple and projecting inwardly from said wall.

2. The disposable insert of claim 1 wherein said insert is connected to a series of identical inserts; a roll formed from said inserts and means for separating each insert from the roll.

3. An enclosure for a disposable nursing bottle insert comprising: a hollow cylinder having a rim at one end thereof defining an opening, an imperforate, nipple-shaped protrusion located on one side of an upper edge of said rim and extending substantially vertically therefrom.

4. The enclosure of claim 3 wherein said enclosure is rigid.

5. The enclosure of claim 3 further including a covering member for said enclosure having an opening in the top thereof.

6. The enclosure of claim 5 wherein an identation is located on a sidewall of said cylinder below said protrusion.

7. The enclosure of claim 6 including a depending skirt for said covering member and a projection located on the inner surface of said skirt and of a size to be received in said indentation.

8. The enclosure of claim 3 wherein said protrusion consist of a stem with a round ball on the end and a hollow, nipple-shaped member received on said ball and stem.

9. The enclosure of claim 8 wherein said nipple-shaped member is made of elastic rubber.

10. A nursing bottle comprising: a rigid cylindrical enclosure having a nipple-shaped protrusion located on a rim thereof, a disposable insert located in said enclosure and having an integral imperforate nipple and an integral perforated nipple, said nipples being received on said protrusion with the imperforate nipple covering the protrusion and the perforated nipple covering the imperforate nipple.

11. The nursing bottle of claim 10 including a covering member for said enclosure, said covering member having an opening that allows the nipples to be mounted on the protrusion.

12. The nursing bottle of claim 11 including means located on the covering member and enclosure for locking the insert therebetween.

* * * * *